US008783400B2

(12) United States Patent
Hirukawa

(10) Patent No.: US 8,783,400 B2
(45) Date of Patent: Jul. 22, 2014

(54) FAN COVER STRUCTURE FOR A RADIATOR ASSEMBLY

(75) Inventor: Masayuki Hirukawa, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 136 days.

(21) Appl. No.: 13/489,796

(22) Filed: Jun. 6, 2012

(65) Prior Publication Data

US 2013/0327496 A1 Dec. 12, 2013

(51) Int. Cl.
*B60K 11/04* (2006.01)

(52) U.S. Cl.
USPC ..... 180/68.4; 180/68.1

(58) Field of Classification Search
USPC ..... 180/68.4, 68.1
See application file for complete search history.

(56) References Cited

U.S. PATENT DOCUMENTS

| | | | | |
|---|---|---|---|---|
| 5,131,352 | A * | 7/1992 | Hoshino et al. | 123/41.49 |
| 5,287,940 | A * | 2/1994 | Ogawa et al. | 180/68.4 |
| 5,341,871 | A * | 8/1994 | Stelzer | 165/121 |
| 5,626,202 | A * | 5/1997 | Barnes et al. | 180/68.1 |
| 6,073,594 | A * | 6/2000 | Tsukiana et al. | 123/41.33 |
| 6,230,792 | B1 * | 5/2001 | Potier | 165/121 |
| 6,510,891 | B2 * | 1/2003 | Anderson et al. | 165/67 |
| 6,554,230 | B1 * | 4/2003 | Horski | 248/49 |
| 6,668,956 | B1 * | 12/2003 | Pelage et al. | 180/68.4 |
| 7,278,504 | B2 * | 10/2007 | Smith et al. | 180/68.3 |
| 7,363,961 | B2 * | 4/2008 | Mori et al. | 165/41 |
| 7,370,717 | B2 * | 5/2008 | Okuno | 180/68.4 |
| 7,418,994 | B2 * | 9/2008 | Evans et al. | 165/41 |
| 7,481,287 | B2 * | 1/2009 | Madson et al. | 180/68.1 |
| 7,703,566 | B2 * | 4/2010 | Wilson et al. | 180/68.4 |
| 7,703,730 | B2 * | 4/2010 | Best et al. | 248/220.22 |
| 8,061,410 | B2 * | 11/2011 | Machanek | 165/76 |
| 8,141,670 | B2 * | 3/2012 | Hayashi et al. | 180/68.6 |
| 8,256,551 | B2 * | 9/2012 | Entriken et al. | 180/68.1 |
| 2006/0278451 | A1 * | 12/2006 | Takahashi et al. | 180/68.1 |
| 2010/0187033 | A1 * | 7/2010 | Hayashi et al. | 180/68.4 |

FOREIGN PATENT DOCUMENTS

| | | |
|---|---|---|
| JP | 2005186911 | 7/2005 |

* cited by examiner

*Primary Examiner* — Jeffrey J Restifo
(74) *Attorney, Agent, or Firm* — Rankin, Hill & Clark LLP

(57) ABSTRACT

A fan cover structure for a radiator assembly having a radiator and a cooling fan having a fan motor is provided. The fan cover structure includes a fan cover for surrounding the cooling fan and a support stay releasably mounted to the fan cover and secured to the radiator. The support stay securely holds the fan cover to the radiator. The support stay includes an arm and the fan cover includes a body having channel defined therein and an engagement member. The channel is dimensioned to receive a portion of the arm and the engagement member is configured to engage the arm portion and retain the arm portion in the channel.

20 Claims, 6 Drawing Sheets

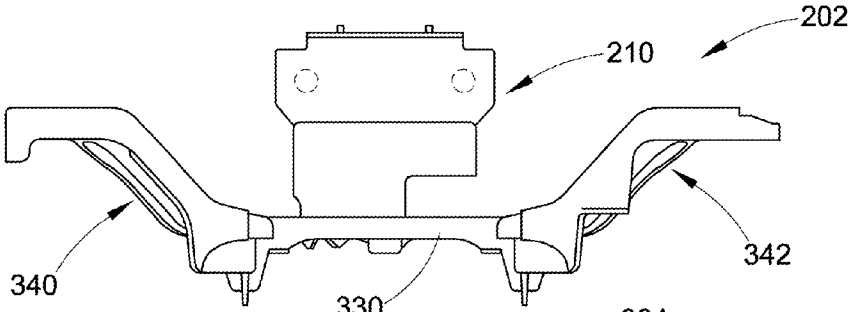
FIG. 8
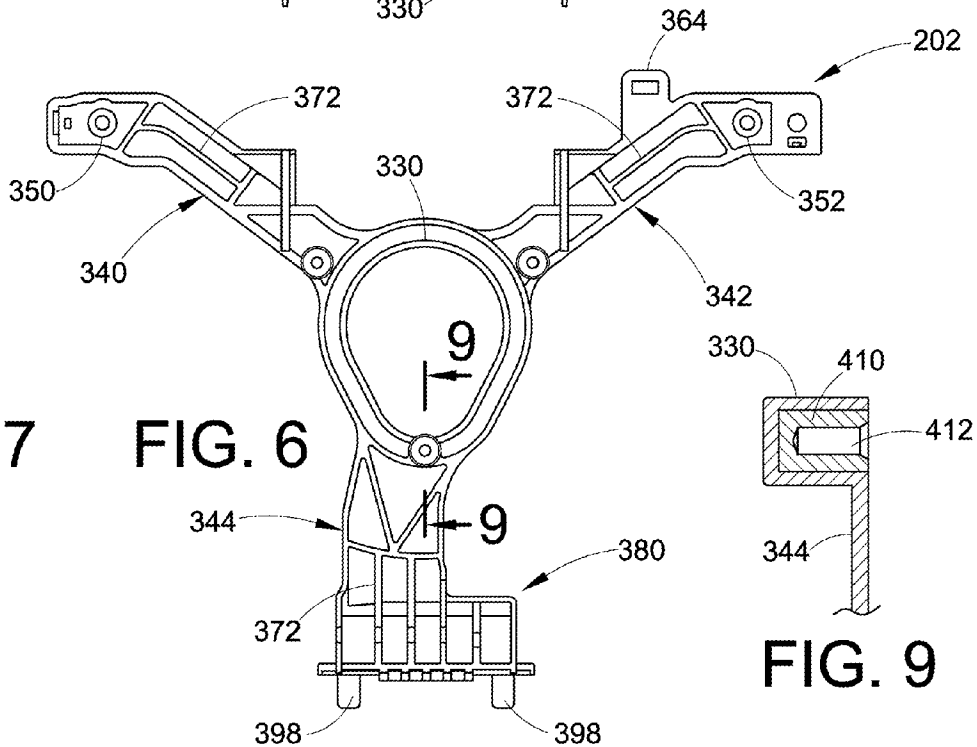
FIG. 6
FIG. 9
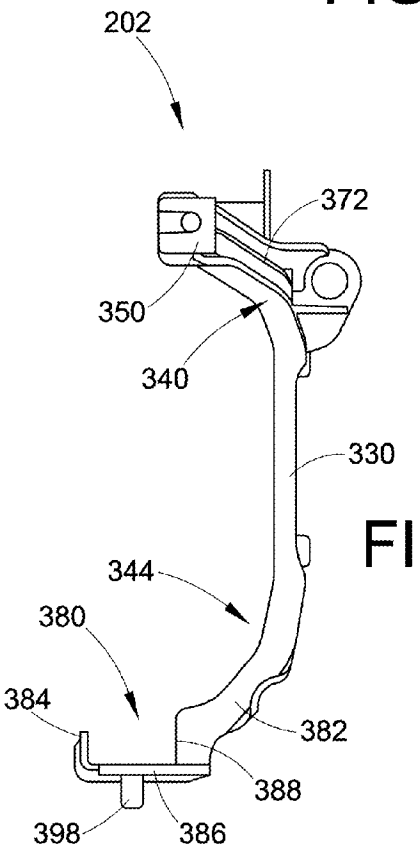
FIG. 7

FAN COVER STRUCTURE FOR A RADIATOR ASSEMBLY

BACKGROUND

Exemplary embodiments herein generally relate to a radiator assembly for a saddle-ride type vehicle such as an ATV (All Terrain Vehicle), and more particularly, to a fan cover structure for the radiator assembly.

In one known example of a radiator assembly for a saddle-ride type vehicle such as an ATV, a cooling fan is attached to a radiator via a fan cover structure. The fan cover structure typically includes a fan stay for holding a fan motor of the cooling fan to the radiator. According to one known configuration, the fan stay is integrally formed with a fan cover which surrounds the cooling fan. According to another known configuration, the fan cover can be a separate member which is fastened to the fan stay. The separate fan stay generally includes a central member for holding the fan motor and three angularly spaced radial arms extending outwardly from the central portion, each arm being secured to the radiator. Typically, the requirement of providing the fan cover for the radiator assembly is dependent upon the country in which the ATV is sold. For example, the fan cover structure provided on an ATV sold in one location may require the fan stay in combination with the fan cover. In contrast, an ATV sold in another location may only require the fan stay. Therefore, with these differing requirements, separate fan cover structures are necessary which can increase costs associated with the ATV.

BRIEF DESCRIPTION

In accordance with one aspect, a fan cover structure for a radiator assembly having a radiator and a cooling fan having a fan motor is provided. The fan cover structure comprises a fan cover for surrounding the cooling fan and a support stay releasably mounted to the fan cover and secured to the radiator. The support stay securely holds the fan cover to the radiator. The support stay includes an arm and the fan cover includes a body having channel defined therein and an engagement member. The channel is dimensioned to receive a portion of the arm and the engagement member is configured to engage the arm portion and retain the arm portion in the channel.

In accordance with another aspect, a radiator assembly for an ATV having a body frame for supporting the radiator assembly comprises a radiator and a cooling fan. The radiator is supported by the body frame. The cooling fan has a cooling fan motor for enhancing heat radiation performance of the radiator. A fan cover structure is mounted to the radiator and configured to support the cooling fan adjacent to the radiator. The fan cover structure includes a fan cover and a separate support stay releasably mounted to the fan cover. The fan cover is securely held between the fan motor and the support stay. The support stay includes an arm and the fan cover includes a body defining a channel dimensioned to receive a portion of the arm. The fan cover further includes an engagement member associated with the channel. The engagement member releasably secures the arm portion within the channel.

In accordance with yet another aspect, a fan cover structure for a radiator assembly having a radiator and a cooling fan having a fan motor is provided. The fan cover structure comprises a fan cover for surrounding the cooling fan. The fan cover includes a body having an outer annular sidewall defining an outer periphery of the fan cover, an inner annular sidewall defining a central opening for receiving the fan motor, and a plurality of spaced apart rings located between the outer and inner sidewalls. The fan cover body further includes three angularly spaced radial channels extending from the inner sidewall to the outer sidewall and at least one engagement member associated with each channel. A support stay is releasably mounted to the fan cover and secured to the radiator. The support stay securely holds the fan cover to the radiator, and includes a central member configured to hold the fan motor and three angularly spaced radial arms extending from the central member. Each channel is dimensioned to receive a portion of one of the arms. The at least one engagement member for each channel is configured to engage the arm portion and retain the arm portion in the channel.

BRIEF DESCRIPTION OF THE DRAWINGS

FIG. 6 is a front view of a support stay of the fan cover structure of FIGS. 2 and 3.

FIG. 7 is a side view of the support stay of FIG. 6.

FIG. 8 is a top view of the support stay of FIG. 6.

FIG. 9 is a partial cross-sectional view of the support stay of FIG. 6 taken along line 9-9 of FIG. 6.

DETAILED DESCRIPTION

It should, of course, be understood that the description and drawings herein are merely illustrative and that various modifications and changes can be made in the structures disclosed without departing from the present disclosure. In general, the figures of the exemplary fan cover structure are not to scale. It should be appreciated that the term "plurality" means "two or more", unless expressly specified otherwise. It will also be appreciated that the various identified components of the exemplary fan cover structure disclosed herein are merely terms of art that may vary from one manufacturer to another and should not be deemed to limit the present disclosure.

Figure 1:
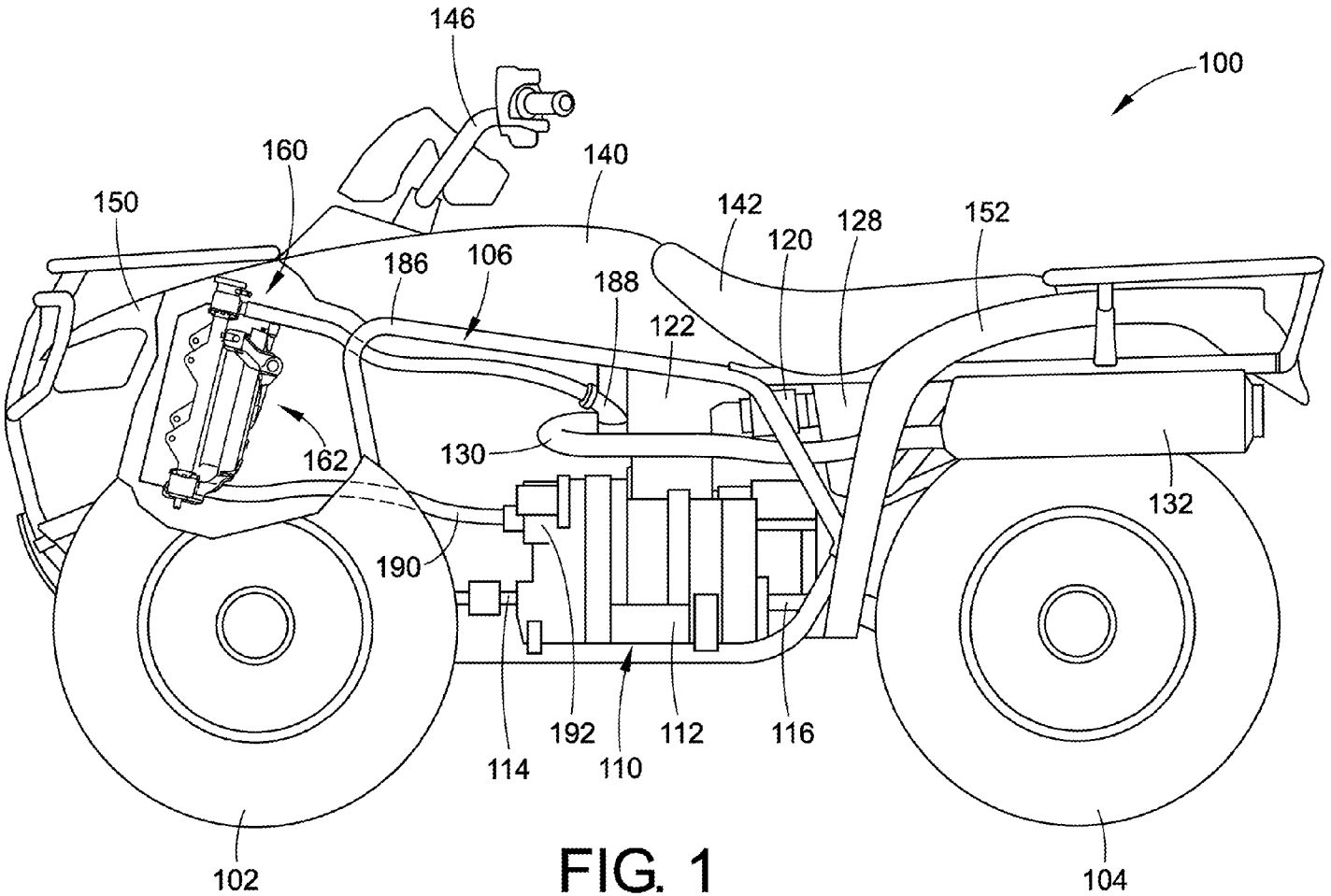
FIG. 1 is a side schematic view of an ATV having a radiator assembly including an exemplary fan cover structure according to the present disclosure.

Referring now to the drawings, wherein like numerals refer to like parts throughout the several views, FIG. 1 schematically illustrates a saddle-ride type four-wheeled vehicle 100. The vehicle 100 is an ATV (All Terrain Vehicle) having left and right front wheels (only left wheel 102 is shown) and left and right rear wheels (only left rear wheel 104 is shown) located in front and rear portions, respectively, of a vehicle body 106. An engine 110 is mounted, as a prime mover for the ATV 100, in an approximately central portion of the body frame 106. The depicted engine 110 is a so-called longitudinal layout engine with the rotational axis of its crankshaft extending in the front-to-rear direction of the vehicle 100. A crankcase 112 making up a lower portion of the engine 110 serves as a transmission case. Front and rear drive shafts 114 and 116 extend forward and rearward from front and rear portions of the crankcase 112, respectively. The front and rear drive shafts 114, 116 are connected to the front wheel and the rear wheels 102,104 via front and rear speed reducing mechanisms (not shown). As is well known, the front wheels are suspended, in a front portion of the body frame 106, by an independent front suspension (not shown), the rear wheels are suspended, in a rear portion of the body frame 106, by a rigid axle rear suspension and swing arms.

With continued reference to FIG. 1, a throttle body 120 is connected to a rear portion of a cylinder section 122 that is vertically installed on the crankcase 112 in the engine 110. An air cleaner case 128 is connected to a rear portion of the throttle body 120. A base end portion of an exhaust pipe 130 is connected to a front portion of the cylinder section 122, and a rear end portion of the exhaust pipe is connected to a silencer or muffler 132 located in a rear portion of the vehicle body 106. A fuel tank 140 and a saddle-type seat 142 are arranged, in this order, from front to rear in an upper central portion relative to the vehicle width direction of the ATV 100. A bar-type handle 146 is slanted rearward and upward of the fuel tank 140 and is attached to an upper end portion of a steering shaft (not shown). A lower end portion of the steering shaft is connected to a front wheel steering mechanism (not shown). Front fenders 150 are attached to a front portion of the body frame 106, and rear fenders 152 are attached to a rear portion of the body frame 106. A radiator assembly 160 for the engine 110 and an exemplary fan cover structure 162 for the radiator assembly 160 are installed in a position downward and forward of the fuel tank 140. It should be appreciated that the above description of the ATV is by way of example only, and that the radiator assembly 160 and exemplary fan cover structure 162 can be implemented in alternative types of vehicles.

Figure 2:
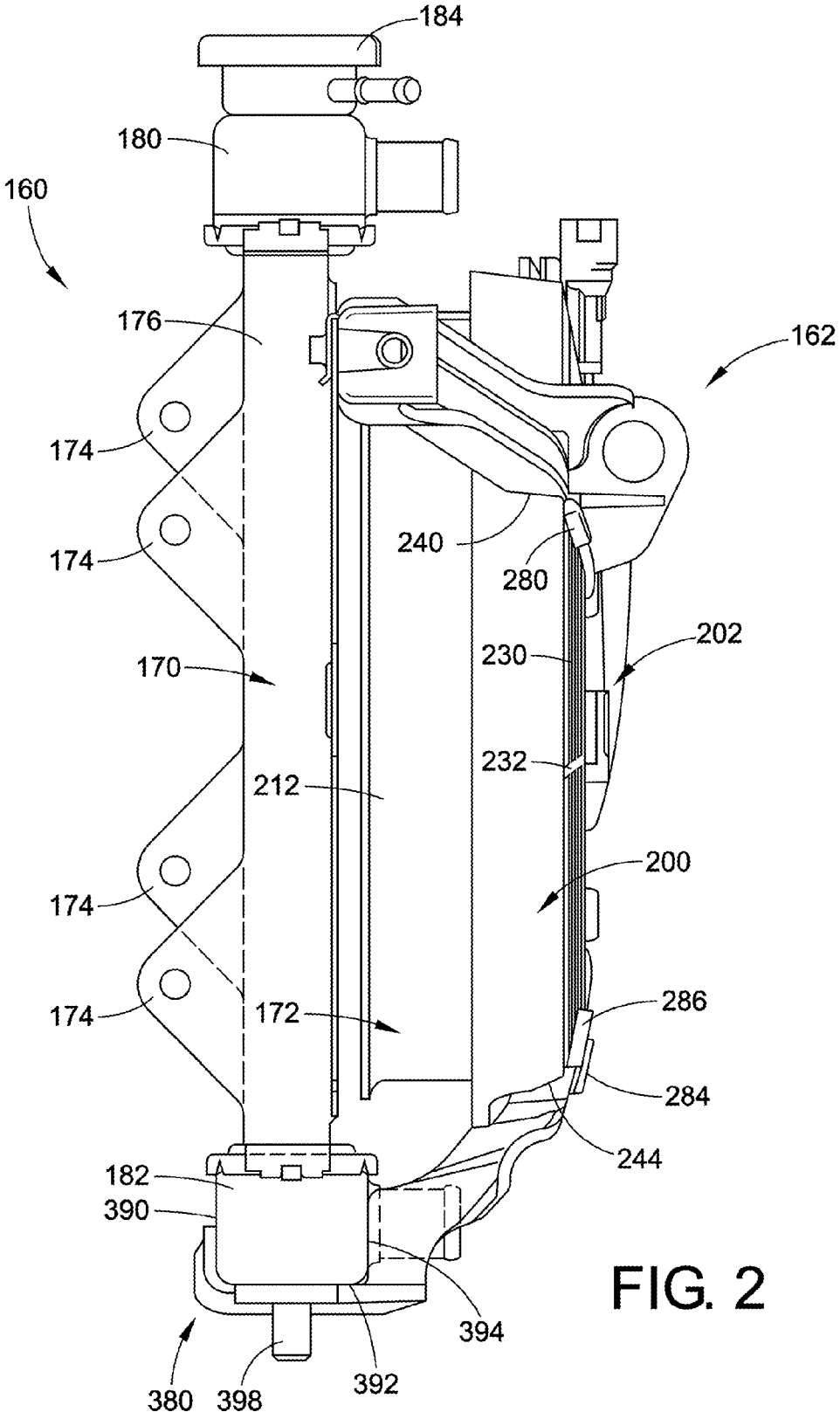
FIG. 2 is a side view of the radiator assembly and fan cover structure of FIG. 1.
Figure 3:
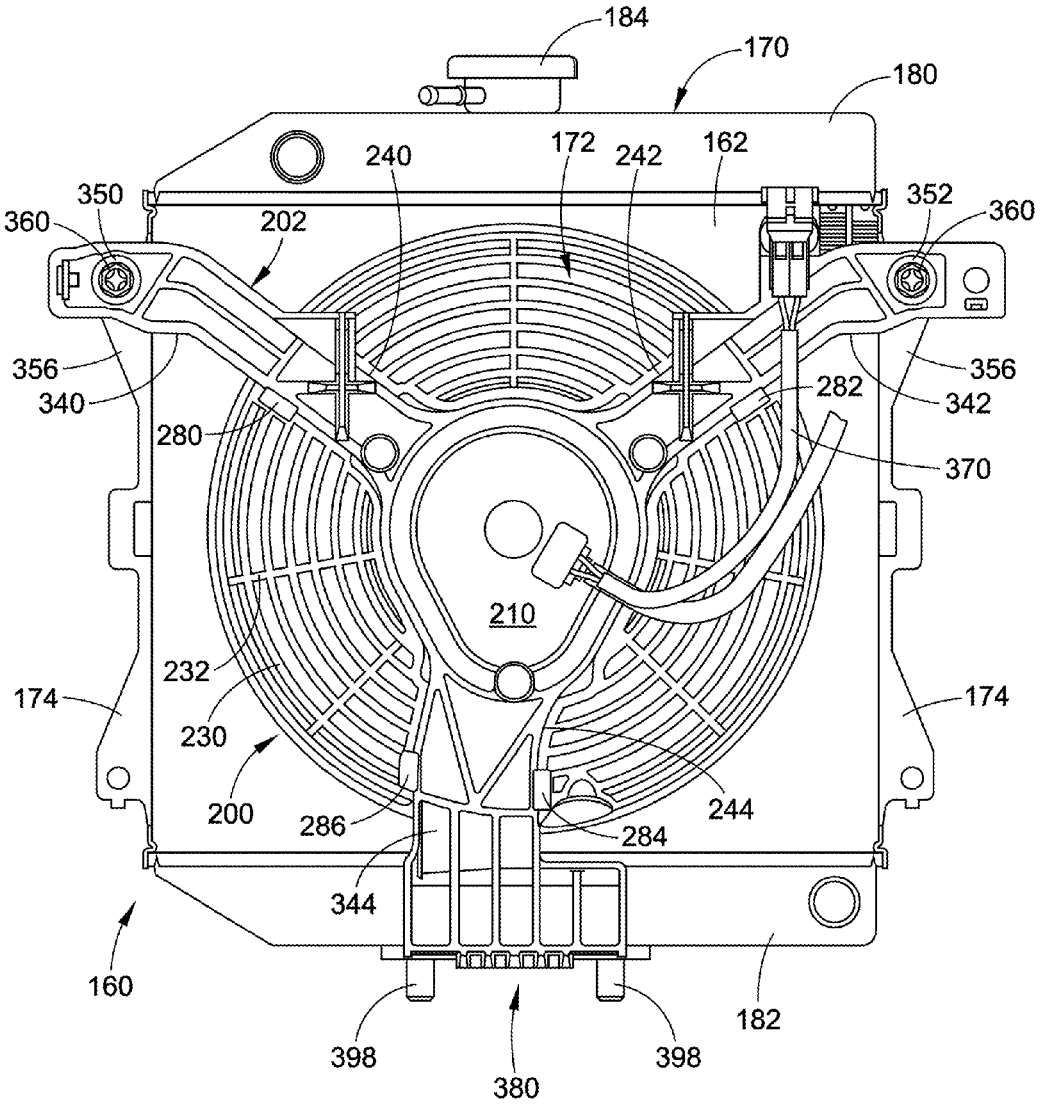
FIG. 3 is a front view of the radiator assembly and fan cover structure of FIG. 2.

With reference to FIGS. 2 and 3, the radiator assembly 160 for the engine 110 includes a radiator 170 and a cooling fan 172 is disposed directly behind the radiator 170. A grille (not shown) is disposed directly in front of the radiator 170 to cover the radiator, and can be mounted to the radiator 170 via a plurality of mounting or support flanges 174 which project from the radiator. The radiator 170 includes a radiator core 176 that can have the shape of an approximately square plate, as viewed from the front. The cooling fan 172 is disposed behind and along an approximately central portion of the radiator core 176. Upper and lower tanks 180 and 182 are disposed along the top side and underside of the radiator core 176, respectively, and can be integrally joined with the radiator core 176. As depicted, the radiator 170 is of a down-flow type (vertical flow type). It is disposed in the ATV 100 in a position slightly inclined rearward, so that, as viewed from a side, an upper portion of the radiator 170 is rearward of a lower portion of the same. A radiator cap 184 is attached to a water supply port of the upper tank 188. As is well known, the radiator cap 188 can have a built-in pressurization valve and a built-in negative pressure valve, so that it can adjust the flow rate of cooling water circulating through the engine 110 and the radiator 170 so as to keep the cooling water pressure in a prescribed range.

Now referring also to FIG. 1, an inlet hose 186 extending from a thermostat 188 disposed in front of the cylinder section 122 is connected to the upper tank 180 above the radiator 170. An outlet hose 190 extends from a water pump 192 disposed in front of the crankcase 112 and is connected to the lower tank 182. As the engine 110 is operated and the water pump 192 is driven, cooling water circulates through the water pump, a cooling water passage in the engine 110, the thermostat 188, the inlet hose 186, the radiator 170 and the outlet hose 190 in the mentioned order. Heat of the engine 110 therefore radiates from the radiator core 176 using the cooling water as a medium. When the engine 110 is operated at low temperature, the thermostat 188 switches the cooling water circulation path to cause the radiator 170 to be bypassed and thereby promote warming up of the engine 110. When the engine 110 is operated at high temperature, the cooling fan 172 is driven to enhance the heat radiation performance of the radiator 170.

With continued reference to FIGS. 2 and 3, the fan cover structure 162 includes a fan cover 200 for surrounding the cooling fan 172 and a support stay 202 releasably mounted to the fan cover 200 and secured to the radiator 170. The support stay 202 supports the cooling fan 172 and secures the cooling fan to the radiator 170. As indicated above, the cooling fan 172 is disposed behind and along an approximately central portion of the radiator core 176. The cooling fan includes a fan motor 210 and a fan body 212. The fan motor 210 has a rotational axis which is approximately perpendicular to the radiator core 176. The fan body 212 is fixed to a forwardly projecting rotary shaft (not shown) of the fan motor 210. The fan motor 210 is fixed to an approximately central portion of the support stay 202 and is supported by the radiator 170 via the support stay 202. As will be described below, the support stay 202 includes at least one arm and the fan cover 200 includes a body 220 having at least one channel defined therein and at least one engagement member. The at least one channel is dimensioned and configured to receive a portion of the at least one arm of the support stay 202 and the at least one engagement member is configured to engage the arm portion and retain the arm portion in the channel.

Figure 4:
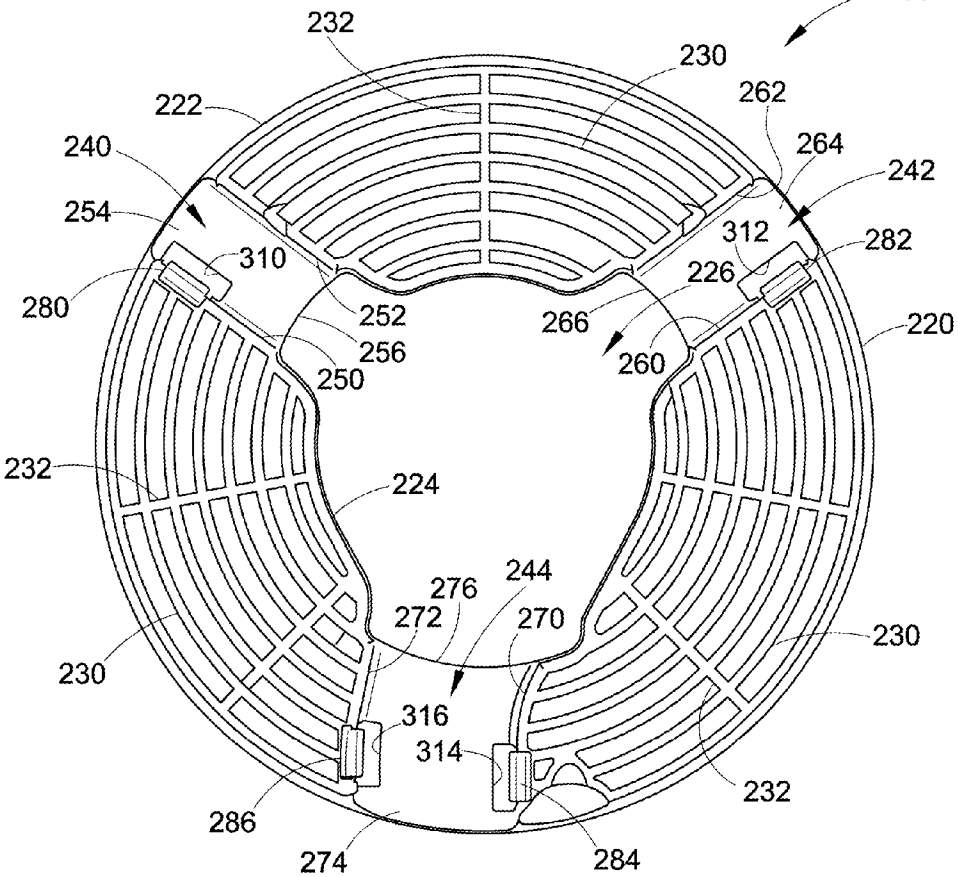
FIG. 4 is a front view of a fan cover of the fan cover structure of FIGS. 2 and 3.
Figure 5:
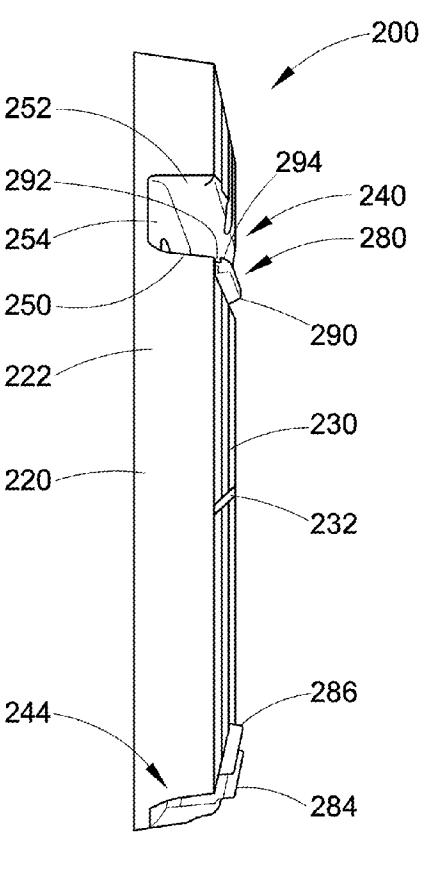
FIG. 5 is a side view of the fan cover of FIG. 4.

As best depicted in FIGS. 4 and 5, the body 220 of the fan cover 200 includes a generally annular outer sidewall 222 defining an outer periphery of the fan cover and an inner sidewall 224 defining a central opening 226. A plurality of spaced apart rings 230 is located between the outer and inner sidewalls 222, 224 and a plurality of radially extending supports 232 which extend from the inner sidewall 224 to the outer sidewall 222 intersects the plurality of rings 230. As stated above, the fan body 220 includes at least one channel. In the exemplary embodiment, the fan body 220 includes three angularly spaced radial channels 240,242,244 which extend from the inner sidewall 224 to the outer sidewall 222. Each channel 240,242,244 is defined by a pair of spaced sidewalls and a base wall interconnecting the sidewall. Particularly, channel 240 is defined by sidewalls 250,252 and base wall 254; channel 242 is defined by sidewalls 260,262 and base wall 264; and channel 244 is defined by sidewalls 270,272 and base wall 274. The inner sidewall 224 also includes an offset section 256 aligned with channel 240, an offset section 266 aligned with channel 242 and an offset section 276 aligned with channel 244. The offset sections 256,266,276 at least partially define the respective channels 240,242,244. The fan cover 200 further includes at least one separate engagement member for each channel 240,242,244. Specifically, engagement member 280 is associated with channel 240, engagement member 282 is associated with channel 242, and a pair of engagement members 284,286 is associated with channel 244.

As shown, each engagement member at least partially projects or extends into its respective channel. More particularly, engagement member 280 includes a body 290 which is at least partially supported by one of the supports 232. The body 290 includes a sidewall 292 which is substantially contiguous with the sidewall 250 (i.e., sidewall 292 is substantially an extension of sidewall 250). Projecting outwardly from sidewall 292 is a tab 294. The tab 294 extends past sidewall 250 and at least partially into the channel 240. The engagement member 280 is also configured to be at least partially resilient which allows for the securement of an arm of the support stay 202 within the channel 240 of the fan cover 200. Its should be appreciated that engagement members 282,284,286 have the exact configuration as engagement member 280, and therefore, a detailed description of such engagement members 282,284,286 will be omitted for conciseness. Though not required, and as best depicted in FIG. 4, located in the base wall 254 of channel 240 is cutout 310, located in the base wall 264 of channel 242 is cutout 312, and located in the base wall 274 of channel 244 is a pair of spaced cutouts 314, 316. The cutouts 310,312,314,316 are aligned with the respective engagement member 240,242,244,246, and can assist in the disassembly of the fan cover structure 162.

With reference now to FIGS. 6-9, the support stay 202 includes a central member 330 shaped substantially annularly as viewed from the front and configured to hold the cooling fan motor 210. As stated above, the support stay 202 further includes at least one arm, and a portion of the at least one arm is retained in a channel via an engagement member. As depicted, the support stay 202 includes three angularly spaced radial arms 340,342,344 extending from a periphery of the central member 330 as viewed from the front. As will be discussed below, a portion of arm 340 is secured in channel 240 via engagement member 280, a portion of arm 342 is secured in channel 342 via engagement member 282, and a portion of arm 344 is secured in channel 244 via the pair of engagement members 284,286. Arm 340 (i.e., the left arm) slants upward and leftward from the central member 330. Arm 342 (i.e., the right arm) slants upward and rightward from the central member 330. Arm 344 (i.e. the lower arm or supporting arm) extends downwardly from the central member 330 and is configured to support a lower portion of the radiator 170. As depicted, the supporting arm 344 can have a width greater than a width of each of the remaining arms 340,342.

As shown, end portions of the left and right arms 340 and 342 are each provided with a flange-abutting part 350, 352, which is mounted to an upper part 356 of the flange 174 on each side of the radiator 170 from behind (FIG. 3). For example, the upper flange part 356 is fitted with a clip nut. Then, screwing a bolt 360 inserted through the upper flange part 356 and the flange-abutting part 350,352 from behind into the clip nut and clamping the clip nut on each side of the radiator 170 clamps the upper sides of the radiator core 176 and the end portions of the left and right arms 340 and 342 together. In FIG. 6, the right arm 342 is provided with a fixture portion 364 for fixing a connector at an end of a power supply harness 370 extending from the cooling fan 172 (see also FIG. 3). Each arm 340,342,344 can also be provided with a plurality of strengthening ribs 372 for added strength and rigidity to the support stay 202.

With particular reference to FIGS. 2, 3, 6 and 7, arm 344 (i.e., the supporting arm) includes a holding portion 380 provided at a distal end 382 of the supporting arm 344. The holding portion 380 has a rear part 384, a base part 386 and a front part 388. The rear part 384 engages a lower rear wall 390 of the lower tank 182 of the radiator 170, the base part 386 engages a bottom wall 392 of the lower tank 182 of the radiator 170, and the front part 388 engages a lower front wall 394 of the lower tank 182 of the radiator 170. Lock pins (not shown) project downward from the bottom wall 392 of the lower tank 182 and are received in corresponding bosses 398 located on the base part 386 of the holding portion 380.

To assemble the fan cover structure 162, each of the arms 340,342,344 are mounted in the corresponding channels 240, 242,244. More particularly, arm 340 is positioned in channel 240 and is releasably retained therein via engagement member 310. Arm 342 is positioned in channel 242 and is releasably retained therein via engagement member 312. Arm 344 is positioned in channel 244 and is releasably retained therein via the pair of engagement members 314 and 316. Once assembled, the fan cover structure 162 is mounted to the radiator assembly 160. Further, the fan cover 200 is sandwiched between the fan stay 202 and the cooling fan 172. The positioning of the arms 240,242,244 in the respective channels 340,342,344 allow for the mounting of the fan cover 200 to the radiator 170 without the need for separate fasteners. When mounting the cooling fan 172 to the radiator 170, the arms 340 and 342 of the support stay 202 can be fastened to the radiator 170 in a state in which the lower support arm 344 has been set to hold the radiator 170 by sandwiching the lower peripheral portion thereof. The flanges 174 are provided in left and right peripheral portions of the radiator 10. The flange-abutting part 350,352 of the respective left and right arms 340,342 are fastened to the upper flanges 174.

Figure 10:
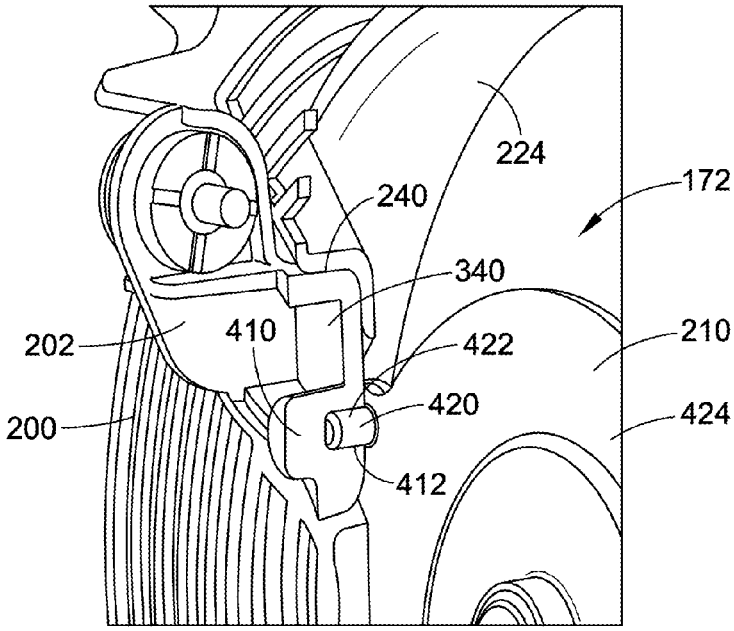
FIG. 10 is an enlarged partial cross-sectional view of the radiator assembly and fan cover structure of FIG. 2.
Figure 11:
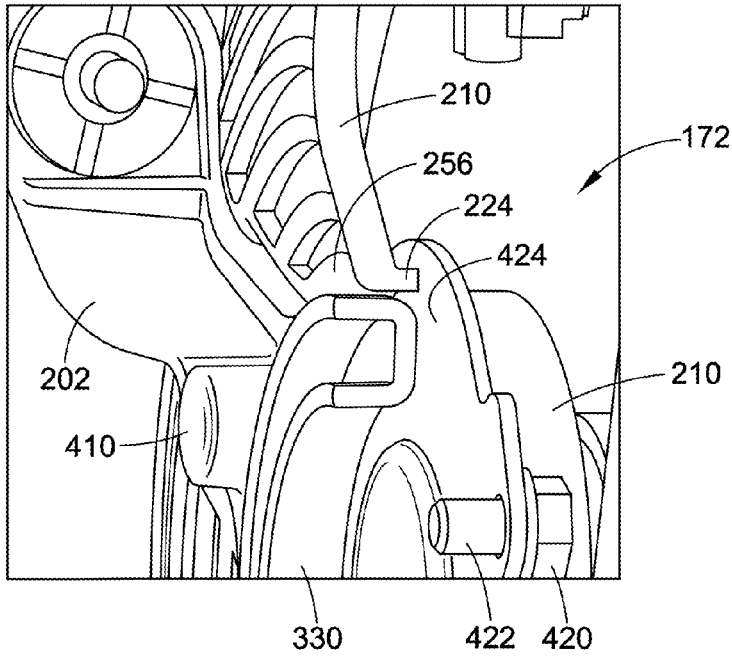
FIG. 11 is an enlarged partial perspective view of the radiator assembly and fan cover structure of FIG. 2.

As indicated previously, the fan motor 210 of the cooling fan is at least partially supported by the central member 330 of the support stay 202. With reference to FIGS. 9-11, to properly position the support stay 202 on the fan motor 210, the support stay 202 includes at least one boss configured to receive at least one mounting member of the fan motor 210. More particularly, the support stay 202 includes a plurality of bosses 410, each boss having an opening 412 extending at least partially therethrough. The fan motor 210 includes a plurality of fasteners 420, having end portions 422 extending outwardly from a central portion 424 thereof. Each opening 412 receives the end portion 422 of one of the fasteners 420 extending from the fan motor 210. Further, in the assembled condition, the body 220 of the fan cover 200 includes the inner sidewall 224 which abuts the fan motor 210. The fasteners 420 are received in the offset sections 256,266,276 of the inner sidewall 224, which again are aligned with the corresponding channels 240,242,244.

As is evident from the foregoing, the present disclosure provides a separate fan cover 200 which is held between the cooling fan 172 and the fan stay 202. The fan stay 202 has a central member 330 for holding the fan motor 210 and three angularly spaced radial arms 340,342,344 extending from the central member. The fan cover 200 includes a body 220 having three angularly spaced radial channels 340,342,344 which are configured to receive the arms of the fan stay 202. Engagement members 280,282,284,286 are provided on the fan cover and extend into the respective channels 340,342, 344 for holding the respective arms 340,342,344 of the fan stay 202 within the channels. With this configuration of the fan cover structure 162, the fan cover structure adheres to the regulations of different countries, but has reduced fasteners and assembly time as compared to known designs. This allows the same components (i.e., the fan cover 200 and fan stay 202) of fan cover structure 162 to be sold in different countries, except that in some locations only the fan stay 202 is required and in other locations both the fan cover 200 and fan stay 202 are provided with the radiator assembly 160 of the ATV 100.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A fan cover structure for a radiator assembly having a radiator and a cooling fan having a fan motor, the fan cover structure comprising:

a fan cover for surrounding the cooling fan; and a support stay releasably mounted to the fan cover and secured to the radiator, the support stay securely holding the fan cover to the radiator, wherein the support stay includes an arm and the fan cover includes a body having channel defined therein and an engagement member, the channel being dimensioned to receive a portion of the arm and the engagement member configured to engage the arm portion and retain the arm portion in the channel.

2. The fan cover structure of claim 1, wherein the fan cover body includes an outer sidewall defining an outer periphery of the fan cover, an inner sidewall defining a central opening and a plurality of spaced apart rings located between the outer and inner sidewalls, the channel extending from the inner sidewall to the outer sidewall.

3. The fan cover structure of claim 2, wherein the support stay has a central member configured to hold the cooling fan motor and three angularly spaced radial arms extending from the central member, and the fan cover body includes three angularly spaced radial channels, each channel being configured to receive a portion of one of the arms of the support stay.

4. The fan cover structure of claim 3, wherein each channel is defined by a pair of spaced sidewalls and a base wall interconnecting the sidewall, the fan cover further including at least one engagement member for each channel, the at least one engagement member at least partially projecting into the channel.

5. The fan cover structure of claim 4, wherein each engagement member includes a tab projecting from one of the sidewalls.

6. The fan cover structure of claim 3, wherein each arm of the support stay includes a boss having an opening extending at least partially therethrough for receiving an associated fastener extending from the fan motor.

7. The fan cover structure of claim 3, wherein one of the arms of the support stay is a supporting arm for supporting a lower portion of the radiator, the supporting arm having a width greater than a width of each of the remaining arms of the support stay.

8. The fan cover structure of claim 7, wherein the fan cover includes a pair of engagement members for securing the support arm in a corresponding channel of the fan cover.

9. The fan cover structure of claim 2, wherein the inner sidewall includes an offset section aligned with the channel, the offset section at least partially defining the channel.

10. A radiator assembly for an ATV having a body frame for supporting the radiator assembly, the radiator assembly comprising:

a radiator supported by the body frame;

a cooling fan having a cooling fan motor for enhancing heat radiation performance of the radiator; and a fan cover structure mounted to the radiator and configured to support the cooling fan adjacent to the radiator, the fan cover structure including a fan cover and a separate support stay releasably mounted to the fan cover, the fan cover being securely held between the fan motor and the support stay, the support stay including an arm and the fan cover including a body defining a channel dimensioned to receive a portion of the arm, the fan cover further including an engagement member associated with the channel, the engagement member releasably securing the arm portion within the channel.

11. The radiator assembly of claim 10, wherein the support stay has a central member configured to hold the cooling fan motor and three angularly spaced radial arms extending from the central member, and the fan cover body includes three angularly spaced radial channels, each channel being configured to receive one of the arms of the support stay.

12. The radiator assembly of claim 11, wherein the fan cover further includes a separate engagement member for each channel, each engagement member extending at least partially into the channel.

13. The radiator assembly of claim 12, wherein each channel is defined by a pair of sidewalls in spaced relation to one another and a bottom wall interconnecting the side walls, and each engagement member includes a tab projecting from one of the sidewalls.

14. The radiator assembly of claim 11, wherein one of the arms of the support stay is a supporting arm configured to support the radiator and includes a holding portion provided at a distal end of the supporting arm, the holding portion having a rear part, a base part and a front part, the rear part engaging a lower rear wall of the radiator, the base part engaging a bottom wall of the radiator and the front part engaging a lower front wall of the radiator.

15. The radiator assembly of claim 14, wherein the supporting arm has a width greater than a width of each of the other arms of the support stay, and the fan cover includes a pair of engagement members for securing the supporting arm in a corresponding channel of the fan cover.

16. The radiator assembly of claim 10, wherein the engagement member includes at least one tab extending at least partially into the channel, the at least one tab engaging the portion of the arm located in the channel.

17. The radiator assembly of claim 10, wherein the fan cover is sandwiched between the fan stay and the cooling fan, the positioning of the arm in the channel allowing for mounting of the fan cover to the radiator assembly without the need for separate fasteners.

18. The radiator assembly of claim 10, wherein the support stay includes a boss having an opening extending at least partially therethrough for receiving an end portion of a fastener extending from the fan motor.

19. The radiator assembly of claim 18, wherein the fan cover body includes an inner sidewall abutting the fan motor, the inner sidewall having an offset section for receiving the fastener, the offset section being aligned with the channel.

20. A fan cover structure for a radiator assembly having a radiator and a cooling fan having a fan motor, the fan cover structure comprising:

a fan cover for surrounding the cooling fan, the fan cover including a body having an outer annular sidewall defining an outer periphery of the fan cover, an inner annular sidewall defining a central opening for receiving the fan motor and a plurality of spaced apart rings located between the outer and inner sidewalls, the fan cover body further including three angularly spaced radial channels extending from the inner sidewall to the outer sidewall and at least one engagement member associated with each channel; and a support stay releasably mounted to the fan cover and secured to the radiator, the support stay securely holding the fan cover to the radiator, wherein the support stay includes a central member configured to hold the fan motor and three angularly spaced radial arms extending from the central member, each channel being dimensioned to receive a portion of one of the arms, the at least one engagement member for each channel configured to engage the arm portion and retain the arm portion in the channel.

* * * * *